US007124786B1

(12) United States Patent
Gowhari

(10) Patent No.: US 7,124,786 B1
(45) Date of Patent: Oct. 24, 2006

(54) LINESMAN PLIERS WITH WIRE SPLICE TWISTER

(76) Inventor: Jacob F. Gowhari, 18245 Rosita St., Tarzana, CA (US) 91356

( * ) Notice: Subject to any disclaimer, the term of this patent is extended or adjusted under 35 U.S.C. 154(b) by 0 days.

(21) Appl. No.: 11/059,022

(22) Filed: Feb. 16, 2005

(51) Int. Cl.
*B21F 7/00* (2006.01)

(52) U.S. Cl. ..... 140/118; 140/117; 140/149

(58) Field of Classification Search ..... 140/118, 140/117, 121, 149, 123; 7/107; 72/409.13, 72/409.14; 81/9.4, 9.41, 424.5, 426.5; 30/91.2, 30/90.1

See application file for complete search history.

(56) References Cited

U.S. PATENT DOCUMENTS

| | | | | | |
|---|---|---|---|---|---|
| 385,318 | A | * | 6/1888 | Norris | 140/118 |
| 513,742 | A | * | 1/1894 | Trout | 140/118 |
| 979,925 | A | * | 12/1910 | Broadbrooks | 81/416 |
| 2,828,780 | A | * | 4/1958 | Gray | 140/123 |
| 3,447,172 | A | * | 6/1969 | Clark | 7/107 |
| 4,104,752 | A | * | 8/1978 | Amrein et al. | 7/107 |
| 4,627,164 | A | * | 12/1986 | Mikic et al. | 30/135 |
| 5,535,519 | A | * | 7/1996 | Brimmer | 30/90.1 |
| 5,711,182 | A | * | 1/1998 | Yang | 72/409.14 |
| 6,081,952 | A | * | 7/2000 | Haxton | 7/107 |

* cited by examiner

*Primary Examiner*—Derris H. Banks
*Assistant Examiner*—Teresa M. Bonk
(74) *Attorney, Agent, or Firm*—Albert O. Cota

(57) ABSTRACT

Linesman type pliers (10) that have provisions for splicing wires together. The pliers (10) have a right body (20) with a first jaw (22) on one end, and a handle (24) on the other end, and a pivotal bore (26) in-between. The first jaw (22) includes a truncated, tapered recess half (28) that is configured to receive an outward-extending stop and the provisions for gripping wire. A left body (32) has a similar jaw, handle, bore and truncated tapered recess half, except with an outward-extending stop (38) on the inner end. A pivot pin (42) is jointly disposed within bores (26) and (36), thus forming a solid-joint that arcuately swivels the right body (20) and left body (32) together into parallel and adjacent alignment. When the jaws are closed a complete, annular, truncated tapered recess (44) is formed that allows insertion of a number of stripped wires that form a twisted splice when the pliers are manually rotated around the stationary wires.

10 Claims, 4 Drawing Sheets

LINESMAN PLIERS WITH WIRE SPLICE TWISTER

TECHNICAL FIELD

The invention generally pertains to special purpose pliers and more specifically to linesman type pliers that have provisions to twist wires between the plier's jaws into an electrical wire splice.

BACKGROUND ART

Previously, many types of hand tools have been used to provide an effective means to twist wires into a splice.

The prior art listed below did not disclose patents that possess any of the novelty of the instant invention, however the following U.S. patents are considered related:

| Patent Number | Inventor | Issue Date |
|---|---|---|
| 2,949,939 | Milla | Aug. 23, 1960 |
| 4,074,732 | Wilkins | Feb. 21, 1978 |
| 4,995,128 | Montgomery et al. | Feb. 26, 1991 |
| 5,711,182 | Yang | Jan. 27, 1998 |
| 6,029,297 | French | Feb. 29, 2000 |

Milla in U.S. Pat. No. 2,949,939 teaches a manually-operated hand held wire splicer having a rectangular U-shaped frame with a flat base. The flat base houses a rotatable shaft with a slot and a series of bores configured to receive stripped wire ends. When a multi-conductor cable is held tightly in the frame and the shaft is rotated, the stripped wires are twisted together to form a splice.

Wilkins in U.S. Pat. No. 4,074,732 discloses a unitary multi-purpose tool that cuts, strips and twists wires together. The utility is for the preparation for installing insulated cap-type twist-on wire connectors and the like.

Montgomery et al. in U.S. Pat. No. 4,995,128 teaches a combination electrician's tool which incorporates a pair of pliers with a crescent wrench on one of the handles, and means to receive screwdriver tips and sockets on the other.

U.S. Pat. No. 5,711,182 issued to Yang is for a crimping tool capable of stripping wires, crimping wire connectors and cutting capscrews.

French in U.S. Pat. No. 6,029,297 discloses multi-purpose electrician pliers capable of wire stripping and wire splicing. The pliers also have the capability of being actuated so as to sandwich a length of a fish tape reel.

For background purposes and as indicative of the art to which the invention is related reference may be made to the remaining cited U.S. Pat. No. 3,131,732 issued to Thurston.

DISCLOSURE OF THE INVENTION

One of the tasks of an electrician is to twist the stripped ends of wires together to form a splice, which is often repeated numerous times. This procedure is accomplished by holding the ends of the wires between the jaws of electricians pliers and, while holding the wires with one hand, twisting the pliers sufficiently to wrap the wires into a spiral. The conventional tool for this procedure is a so called "linesman pliers", which incorporate a solid joint with diagonal cutting blades and crimping surfaces, as well as forward jaws that are used to hold the stripped wires.

Therefore, the primary object of the invention is to modify conventional linesman pliers by adding a tapered recess within the surface of the jaws. The recess is truncated and contains a stop at the end. There are recesses and protrusions in the plier's sides for gripping stripped wires and guiding them into a spiral twist as the pliers are manually rotated.

An important object of the invention is that the recess is not only tapered but is preferably in an oval shape, which along with the protrusions and recesses grips the wires tightly when inserted, thus making it easy to hold the plier's handles loosely when turning by hand.

Another object of the invention is that the taper on the recess forms the twisted wires into a loose twist on one end and a tighter twist as it is rotated, thereby forming a cone shaped splice which uniformly mates with wire nuts and the like that encloses the spliced wires.

Still another object of the invention is the simplicity of design, as the usual features of a linesman pliers stay unchanged and the function of the plier's jaws remain intact, as only the inner surface contains the recess.

Yet another object of the invention is that the utility of the pliers is expanded at little expense to the manufacturer, as the changes may be made in the plier's original tooling, which affects the cost only slightly as the tooling price is amortized over time.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
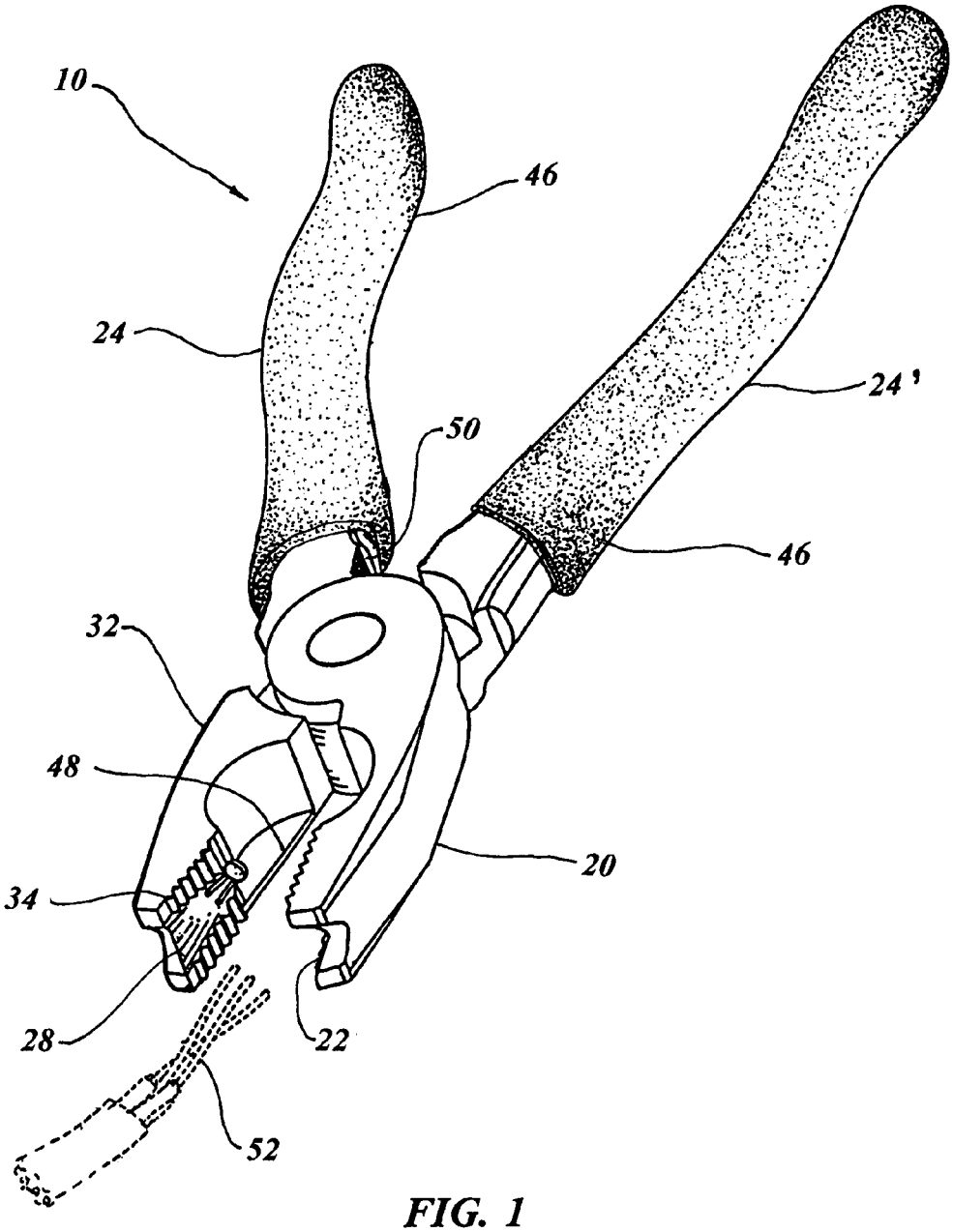
FIG. 1 is a partial isometric view of the preferred embodiment with the jaws open and a plurality of wires ready to be twisted into a splice shown dotted.
Figure 2:
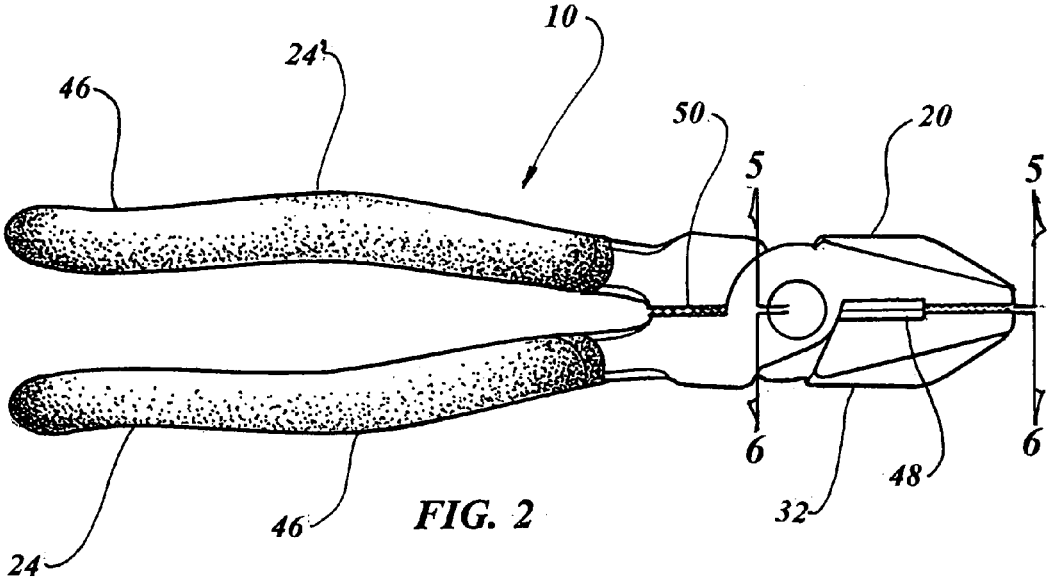
FIG. 2 is a plan view taken of the preferred embodiment illustrated with the jaws closed.
Figure 3:
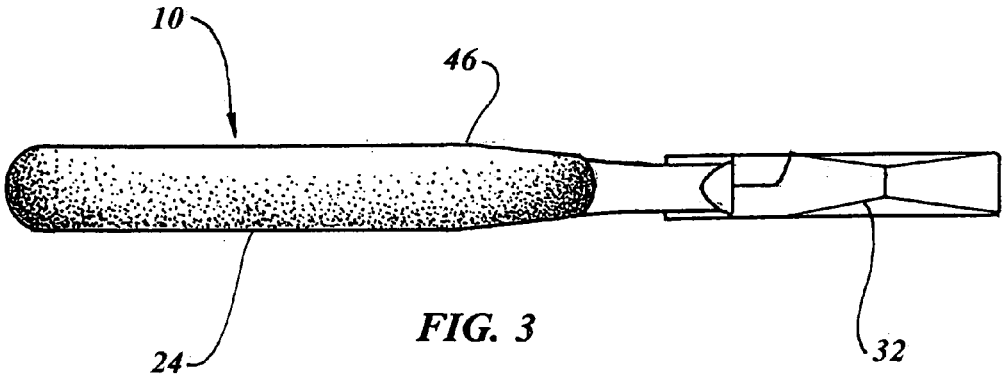
FIG. 3 is a side view taken of the preferred embodiment.

The best mode for carrying out the invention is presented in terms of a preferred embodiment for a linesman pliers 10. The pliers 10 have provisions for splicing wires, as shown in FIGS. 1 through 11, and are comprised of an elongated right body 20 that has a first jaw 22 on one end and a handle 24 on the other end. The right body 20, as viewed from the handle end, has a first pivotal bore 26 in-between the first jaw 22 and the handle 24. The first jaw 22 incorporates a truncated tapered recess half 28 that is configured to receive an outward-extending stop. The first jaw 22 also has wire gripping means in the form of a plurality of recessed, grooved indentations 30, as shown in FIGS. 5, 7 and 9–11.

Figure 4:
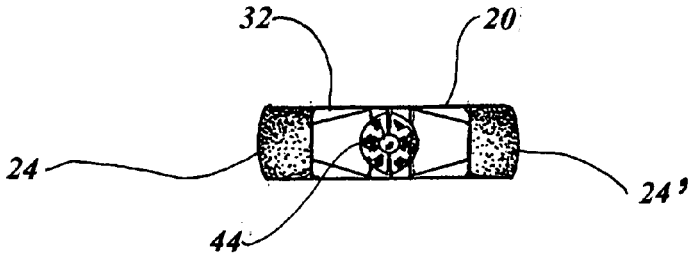
FIG. 4 is front end view of the preferred embodiment with the jaws closed.
Figure 5:
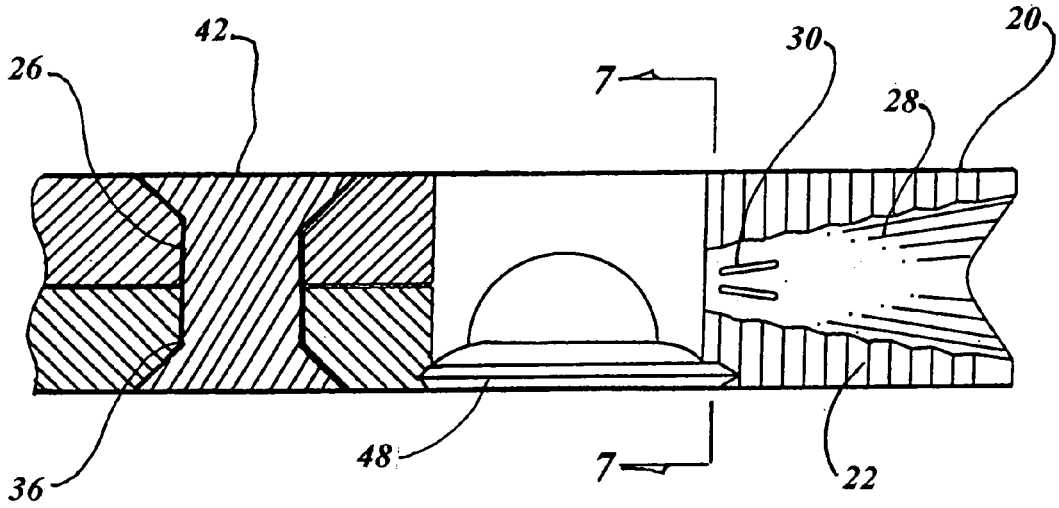
FIG. 5 is a cross-sectional view taken along lines 5—5 of FIG. 2 depicting the inner surface of the right elongated body jaws and tapered recess within.
Figure 6:
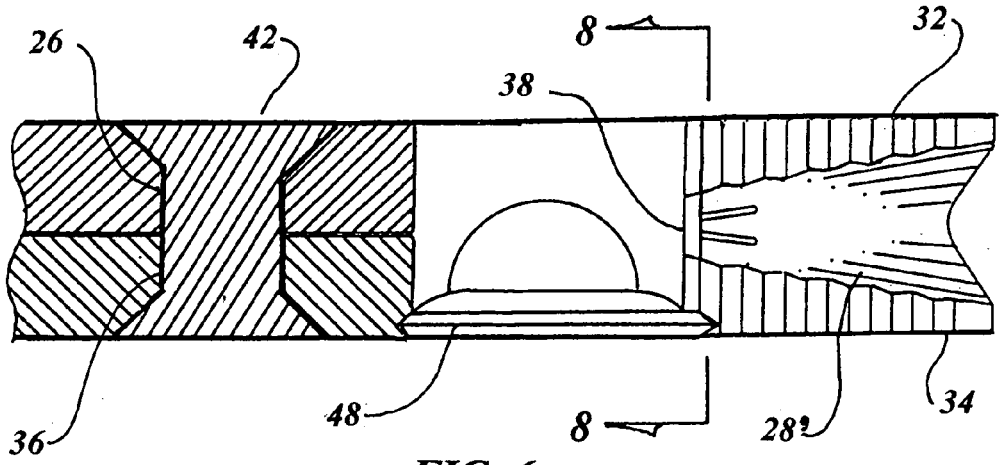
FIG. 6 is a cross-sectional view taken along lines 6—6 of FIG. 2 depicting the inner surface of the left elongated body jaws and tapered recess within.
Figure 7:
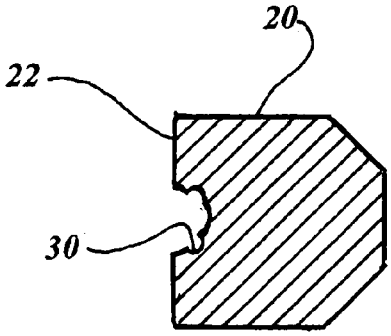
FIG. 7 is a cross-sectional view taken along lines 7—7 of FIG. 5.
Figure 8:
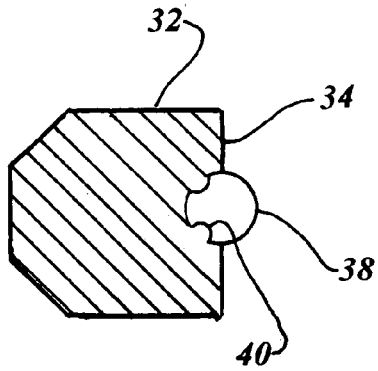
FIG. 8 is a cross-sectional view taken along lines 8—8 of FIG. 6.
Figure 9:
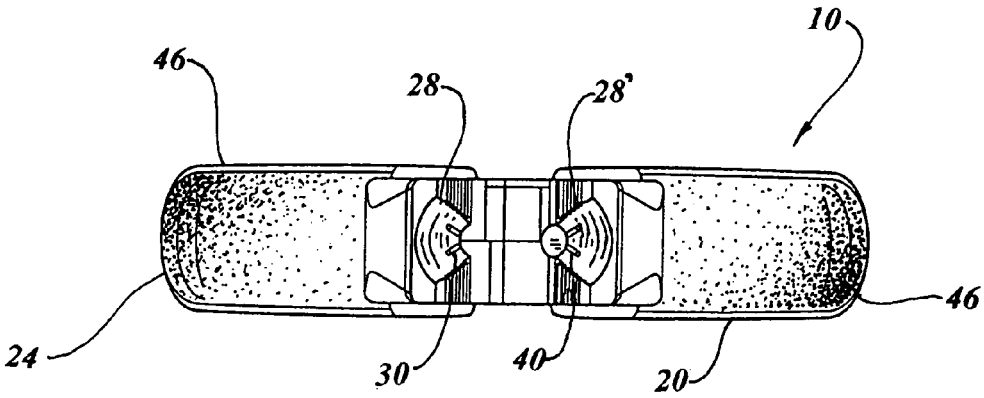
FIG. 9 is front end view of the preferred embodiment with the jaws opened.
Figure 10:
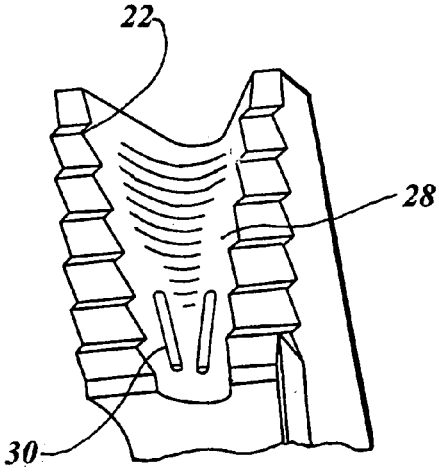
FIG. 10 is a partial isometric view of the inner surface of the right jaw as viewed from the handle end of the preferred embodiment.
Figure 11:
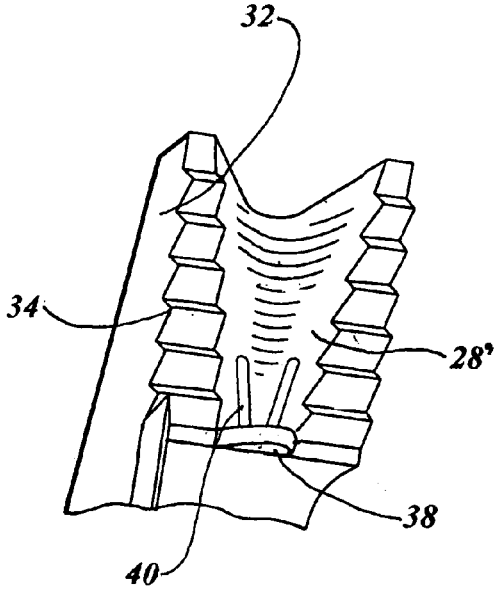
FIG. 11 is a partial isometric view of the inner surface of the left jaw as viewed from the handle end of the preferred embodiment.

The pliers 10 utilize an elongated left body 32 having a second jaw 34 on one end and a handle 24' on the other end, with a second pivotal bore 36 in-between. The second jaw 34 also includes a truncated, tapered recess half 28' therein, with an outward-extending stop 38, as illustrated in FIGS. 1, 6, 8, 9 and 11. The stop 38 is in the form of a round disc-like protrusion that is located in the end of the tapered recess half 28' and is contiguous with the end of the tapered recess half 28 within the first jaw 22, as shown in FIG. 4.

The truncated, tapered recess half 28' in the second jaw 34 also includes wire gripping means, however they are in the form of a plurality of raised fingers 40, which are preferably semi-circular in shape and protrude from the outward-extending stop 38. The fingers 40 provide a gripping surface to resist the movement of a stripped wire when contiguously engaging the tapered portions 28 and 28'. The fingers 40 are depicted in FIGS. 1, 4, 6, 8, 9 and 11. It should be noted that the indentations 30 and raised fingers 40 may be interchanged between the first jaw 22 and the second jaw 34, or they may optionally be either indentations 30 or fingers 40 in either jaw 22 or 34.

A pivot pin 42 is jointly disposed within the first pivotal bore 26 and the second pivotal bore 36, thereby forming a solid-joint that arcuately allows the elongated right body 20 to swivel relative to the elongated left body 32. This design permits the first jaw 22, second jaw 34 and outwardly extending stop 38 to be parallel and adjacent. The pivoting action provides a complete, annular, truncated tapered recess 44 that is formed of the two halves 28 and 28', as shown in FIG. 4.

The complete truncated tapered recess 44 is oval in shape at its initial opening and tapers to a round shape at the outward-extending stop 38. Each truncated tapered recess 28 and 28' preferably have a taper from 8 to 10 degrees at its narrow side, and from 10 to 14 degrees on its widest side, thus permitting the insertion of a number of stripped wires that form a twisted splice when the linesman pliers are manually rotated on a plurality stationary wires.

The linesman pliers 10 may include a resilient dielectric grip 46 that covers each handle 24 and 24' for comfort and electrical isolation. Optionally, diagonal cutting blades 48 may be incorporated within the elongated right body 20 and left body 32. The cutting blades 48 are positioned between the first and second jaw 22, 34 and the pivot pin 42. A crimping surface 50, having a plurality of teeth for gripping, may be added to the right body 20 and the left body 32. The crimping surface 50 is located between the pivot pin 42 and each of the handles 24 and 24'.

Figure 12:
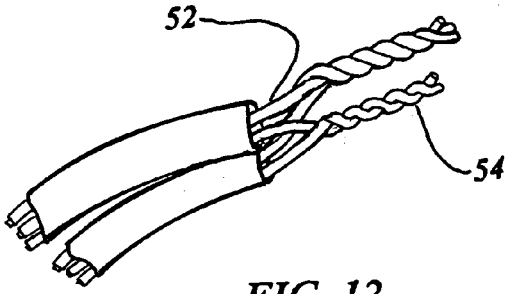
FIG. 12 is a partial isometric view of a wire cable, with the wires stripped and twisted into a splice connection with the preferred embodiment of the invention.

When in use, the pliers 10 function as any conventional linesman pliers, with the utility of gripping items between the jaws 22 and 34, as well as cutting and crimping connectors together. When twisting wires 52 together is required to form a splice 54, a workman strips the ends of the wires in a conventional manner. The workman then gathers the ends together and inserts them into the oval shaped, complete recess 44 that are located in the end of the jaws 22 and 34 until they engage the stop 38 or impinge tightly on the jaw sides. The workman then manually twists the pliers 10 in a revolving manner until the splice 54 is completed and the jaws are opened. The raised fingers 40 and opposed indentations 30 grab the stripped wires 52 and holds them in place during the rotation of the handles 24 and 24'. The wires 52 are shown dotted in FIG. 1, and a completed splice 54 is illustrated in FIG. 12. It should be noted that any number of wires 52 may be spliced together, limited only to their physical size and numbers. However, the most common wire sizes are 14, 12 and 10 AWG which are normally used with this type of tool, and 4–5 wires are the usual maximum amount that are spliced together.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A linesman pliers having provisions for splicing wires which comprises:

a) an elongated right body having a first jaw on one end, and a handle on the other end, with a first pivotal bore in-between, wherein said first jaw having a truncated, tapered recess half located therein that is configured to receive an outward-extending stop and wire gripping means, b) an elongated left body having a second jaw on one end, and a handle on the other end, with a second pivotal bore in-between, wherein said second jaw having a truncated, tapered recess half located therein with an outward-extending stop and wire gripping means, c) wherein said truncated, tapered recess is oval in shape at its initial opening, and tapers to a round shape at the outward-extending stop, and d) a pivot pin jointly disposed within said first pivotal bore and second pivotal bore, thereby forming a solid-joint that arcuately swivels the elongated right body relative to the elongated left body until the first jaw second jaw and outward-extending stop are parallel and adjacent thereunto, thus providing a complete, annular, truncated tapered recess for insertion of a plurality of stripped wires that form a twisted splice when the linesman pliers are manually rotated on a plurality of stationary wires.

2. The linesman pliers as recited in claim 1 wherein said truncated, tapered recess has a taper from 8 to 12 degrees at its narrow side, and from 10 to 14 degrees on its wider side.

3. The linesman pliers as recited in claim 1 wherein said outward-extending stop is round in shape.

4. A linesman pliers having provisions for splicing wires which comprises:

a) an elongated right body having a first jaw on one end, and a handle on the other end, with a first pivotal bore in-between, wherein said first jaw having a truncated, tapered recess half located therein that is configured to receive an outward-extending stop and wire gripping means, b) an elongated left body having a second jaw on one end and a handle on the other end, with a second pivotal bore in-between wherein said second jaw having a truncated, tapered recess half located therein with an outward-extending stop and wire gripping means, c) wherein said wire gripping means further comprises a plurality of recessed, grooved indentations that are located in the first jaw's truncated, tapered recess half, with said second jaw truncated, tapered, recess half having a plurality of raised fingers that protrude from said outward-extending stop, thus providing a gripping surface to resist the movement of a stripped wire when contiguously engaging the tapered portion thereof, and d) a pivot pin jointly disposed within said first pivotal bore and second pivotal bore, thereby forming a solid-joint that arcuately swivels the elongated right body relative to the elongated left body until the first jaw, second jaw and outward-extending stop are parallel and adjacent thereunto, thus providing a complete, annular, truncated tapered recess for insertion of a plurality of stripped wires that form a twisted splice when the linesman pliers are manually rotated on a plurality of stationary wires.

5. The linesman pliers as recited in claim 1 further comprising the solid joint type.

6. The linesman pliers as recited in claim 1 wherein said elongated right body handle and said elongated left body handle further comprise a resilient, dielectric grip that covers each handle for comfort and electrical isolation.

7. The linesman pliers as recited in claim 1 further comprising diagonal cutting blades on said elongated right body, and said elongated left body, positioned between said first jaw, said second jaw and said pivot pin.

8. The linesman pliers as recited in claim 1 further comprising a crimping surface on said elongated right body, and said elongated left body, positioned between said pivot pin and said handles.

9. The linesman pliers as recited in claim 8 wherein said crimping surface further comprises a plurality of teeth that are used for gripping.

10. The linesman pliers as recited in claim 1 wherein said pliers are used with wire sizes 14, 12 and 10 AWG.

* * * * *